US005795622A

United States Patent [19]

Belt et al.

[11] Patent Number: 5,795,622

[45] Date of Patent: Aug. 18, 1998

[54] METHOD OF ROTATING OR OSCILLATING A FLOW OF GRANULES TO FORM A PATTERN ON AN ASPHALT COATED SHEET

[75] Inventors: James S. Belt, Utica; Frank R. Wilgus, Powell; Frank A. Wilgus, Westerville, all of Ohio

[73] Assignee: Owens-Corning Fiberglas Technology, Inc., Summit, Ill.

[21] Appl. No.: 774,432

[22] Filed: Dec. 30, 1996

[51] Int. Cl.[6] ..... B05D 1/12

[52] U.S. Cl. ..... 427/186; 427/187; 427/188

[58] Field of Search ..... 427/186, 187, 427/188; 118/311, 323

[56] References Cited

U.S. PATENT DOCUMENTS

| | | | |
|---|---|---|---|
| D. 83,718 | 3/1931 | Brown . | |
| D. 89,471 | 3/1933 | Streeter et al. . | |
| D. 93,191 | 8/1934 | Topping . | |
| 978,333 | 12/1910 | Overbury . | |
| 1,295,360 | 2/1919 | Overbury . | |
| 1,345,627 | 7/1920 | Overbury . | |
| 1,445,991 | 2/1923 | Butterick . | |
| 1,583,563 | 5/1926 | Abraham . | |
| 1,669,166 | 5/1928 | Keller | 427/188 |
| 1,820,005 | 8/1931 | Maclean . | |
| 1,956,285 | 4/1934 | Harshberger . | |
| 2,037,788 | 4/1936 | Hultberg | 427/188 |
| 2,037,822 | 4/1936 | Robert | 427/188 |
| 2,044,788 | 6/1936 | Harshberger et al. . | |
| 2,111,761 | 3/1938 | Eckert . | |
| 2,129,288 | 9/1938 | Shattuck . | |
| 2,175,226 | 10/1939 | Slayter . | |
| 2,316,093 | 4/1943 | MacNutt . | |
| 2,348,223 | 5/1944 | Papesh . | |
| 2,523,759 | 9/1950 | Grant . | |
| 2,676,155 | 4/1954 | Farris . | |
| 2,771,387 | 11/1956 | Kleist et al. . | |
| 3,332,830 | 7/1967 | Tomlinson et al. . | |
| 3,919,823 | 11/1975 | Bradley | 52/553 |
| 4,233,100 | 11/1980 | Cunningham et al. | 156/260 |
| 4,274,243 | 6/1981 | Corbin et al. | 52/748 |
| 4,333,279 | 6/1982 | Corbin et al. | 52/105 |
| 4,359,873 | 11/1982 | Miller | 62/63 |
| 4,399,186 | 8/1983 | Lauderback | 428/291 |
| 4,468,430 | 8/1984 | Ruede | 428/291 |
| 4,583,486 | 4/1986 | Miller | 118/308 |
| 5,186,980 | 2/1993 | Koschitzky | 427/187 |
| 5,405,647 | 4/1995 | Grubka et al. | 427/188 |
| 5,429,676 | 7/1995 | Uchida et al. | 118/310 |
| 5,488,807 | 2/1996 | Terrenzio et al. | 52/555 |
| 5,520,889 | 5/1996 | Burton et al. | 427/188 |
| 5,547,707 | 8/1996 | Haubert et al. | 427/188 |
| 5,614,254 | 3/1997 | Musata et al. | 427/180 |

OTHER PUBLICATIONS

The Ruberoid Company, "Instructions for Laying 11×32 Inch–Shingles In Varied Designs," dated 1921.

*Primary Examiner*—Shrive Beck
*Assistant Examiner*—Fred J. Parker
*Attorney, Agent, or Firm*—C. Michael Gegenheimer; Ted C. Gillespie; Gary M. Sutter

[57] ABSTRACT

In a method of forming a pattern of granules on an asphalt coated sheet moving in a machine direction, a flow of separate first granules and second granules is discharged onto the sheet. The flow of granules is rotated to form a pattern of first and second granules on the sheet that changes along the machine direction. Another embodiment of the invention provides a method of forming a pattern of granules, in which the flow of granules is oscillated in a direction transverse to the machine direction. The flow of granules can also be discharged intermittently onto the sheet.

22 Claims, 8 Drawing Sheets

METHOD OF ROTATING OR OSCILLATING A FLOW OF GRANULES TO FORM A PATTERN ON AN ASPHALT COATED SHEET

CROSS-REFERENCE TO RELATED APPLICATIONS

This application is related to the following commonly filed and co-pending applications: U.S. application Ser. No. 08/774,433, filed Dec. 30, 1996, entitled "Method and Apparatus for Forming an Irregular Pattern of Granules on an Asphalt Coated Sheet", by Belt et al., and U.S. application Ser. No. 08/781,898, filed Dec. 30, 1996, entitled "Method and Apparatus for Applying Granules to an Asphalt Coated Sheet to Form a Pattern having Inner and Outer Portions", by Belt et al.. Both of these related applications are incorporated by reference herein.

TECHNICAL FIELD AND INDUSTRIAL APPLICABILITY

This invention relates in general to the handling of continuous sheets of asphalt material, such as asphalt material suitable for use as roofing shingles and roll roofing. More particularly, this invention relates to a method of rotating or oscillating a flow of granules to form a pattern on an asphalt coated sheet.

BACKGROUND OF THE INVENTION

A common method for the manufacture of asphalt shingles is the production of a continuous sheet of asphalt material followed by a shingle cutting operation which cuts the material into individual shingles. In the production of asphalt sheet material, either a glass fiber mat or an organic felt mat is passed through a coater containing hot liquid asphalt to form a tacky, asphalt coated sheet. Subsequently, the hot asphalt coated sheet is passed beneath one or more granule applicators which discharge protective surface granules onto portions of the asphalt sheet material.

In the manufacture of colored shingles, two types of granules are typically employed. Headlap granules are granules of relatively low cost used for the portion of the shingle which will be covered up on the roof. Colored granules or prime granules are of relatively higher cost and are applied to the portion of the shingle which will be exposed on the roof.

To provide a color pattern of pleasing appearance, the colored portion of the shingles may be provided with areas of different colors. Usually the shingles have a background color and a series of granule deposits of different colors or different shades of the background color. The term "blend drop", as used herein, refers to the flow of granules of different colors or different shades of color that is discharged from a granule applicator toward the asphalt coated sheet. The term "granule deposit", as used herein, refers to the blend drop of granules after it has been deposited on the sheet.

A common method for manufacturing the shingles is to discharge blend drops onto spaced areas of the tacky, asphalt coated sheet. Background granules are then discharged onto the sheet and adhere to the tacky, asphalt coated areas of the sheet between the granule deposits formed by the blend drops.

One of the problems with typical granule application equipment is that it depends on mechanical movement to discharge blend drops onto the moving asphalt coated sheet. Usually the granules are fed from a hopper onto a fluted roll from which, upon rotation, the granules are discharged onto the sheet. The roll is ordinarily driven by a drive motor, and the roll is positioned in the drive or non-drive position by means of a brake-clutch mechanism. The requirement for mechanical action has inherent limitations which prevent a very precise beginning and ending to the blend drop. Also, once the mechanical action takes place, there is a short time lag as gravity takes effect on the granules and they drop onto the moving asphalt coated sheet. Consequently, there is a limit to the sharpness of the granule deposits on the shingle. As shingle manufacturing lines go up in speed, the lack of sharpness is accentuated and the distinction between the granule deposits and the background color becomes fuzzy. The lack of sharpness puts a severe limitation on the kinds of patterns and color contrasts which can be applied to shingles at high production speeds.

One method for manufacturing shingles having sharply defined granule deposits involves the application of the background color granules over the entire exposed tacky surfaces of the shingles. Adhesive such as hot asphalt is then applied in a pattern on top of the background color granules on the sheet, in the areas where the granule deposits are to be applied. Then the granule deposits are applied and adhere to the shingle only on the areas of adhesive. This method of applying granules is described in U.S. Pat. No. 4,352,837, issued Oct. 5, 1982 to Kopenhaver. Unfortunately, the application of the double layer of granules in the areas of granule deposits make these shingles relatively expensive, heavy and inflexible.

A recently developed improved method for discharging blend drops onto the moving asphalt coated sheet uses an apparatus known as a pneumatic blender. This apparatus employs a pneumatic gating mechanism to provide a relatively high degree of precision in discharging the blend drops. The flow of granules is started, stopped and controlled by providing pneumatic pressure changes in a buffer chamber positioned adjacent an accumulation of granules in a granule nozzle. When the pneumatic pressure is increased, the flow of granules is ejected under pressure onto the moving asphalt coated sheet instead of dropping solely by gravity. These features of the pneumatic blender allow more sharply defined granule deposits to be formed on the moving asphalt coated sheet. A preferred pneumatic blender is disclosed in U.S. Pat. No. 5,520,889, issued May 28, 1996 to Burton et al. (incorporated by reference herein).

Other improvements have also been made in methods of applying granule deposits. For example, U.S. Pat. No. 5,405,647, issued Apr. 11, 1995 to Grubka et al., discloses a method for applying granules to a moving asphalt coated sheet to form areas having sharp leading and trailing edges. However, it would still be desirable to provide a method for making a variety of unique and attractive patterns of granule deposits on asphalt coated sheets. Granule deposits applied by typical methods come in a limited variety of patterns, such as a rectangular patterns or drop-shaped patterns. Typical granule deposits are also formed of a single color or color blend of granules. Thus, it would also be desirable to provide patterns of first and second colors of granules on the sheet in which the pattern changes along the sheet. Further it would be desirable to provide these and other patterns without the drawbacks of applying a double layer of granules on the sheet.

SUMMARY OF THE INVENTION

The above objects as well as other objects not specifically enumerated are achieved by a method of forming a pattern of granules on an asphalt coated sheet moving in a machine direction. In the method, a flow of separate first granules and second granules is discharged onto the sheet. The flow of granules is rotated to form a pattern of first and second granules on the sheet that changes along the machine direction. Another embodiment of the invention provides a method of forming a pattern of granules, in which the flow of granules is oscillated in a direction transverse to the machine direction. The flow of granules can also be discharged intermittently onto the sheet. The rotation, oscillation, and intermittent discharge can be controlled together to produce a wide variety of unique and attractive patterns on the sheet.

DETAILED DESCRIPTION AND PREFERRED EMBODIMENTS

This invention will be described in relation to rotating and/or oscillating a flow of granules. It should be understood that the rotation and/or oscillation can include rotating and/or oscillating a granule applicator, the nozzle of a granule applicator, an orifice through which the flow of granules is discharged, or any other means for rotating and/or oscillating the flow of granules while discharging the flow. The rotation and/or oscillation can also include any means for rotating and/or oscillating the flow of granules after it has been discharged, for example by pneumatic means such as air jets or mechanical means such as deflectors. The rotation and/or oscillation can be in a continuous motion, or it can be in discrete steps.

Further, while the invention is described in relation to roofing shingles, it should be understood that the invention is applicable to any type of asphalt sheet material, such as roll roofing, roofing shingles with or without cutouts, or other forms of asphalt sheet material.

Figure 1:
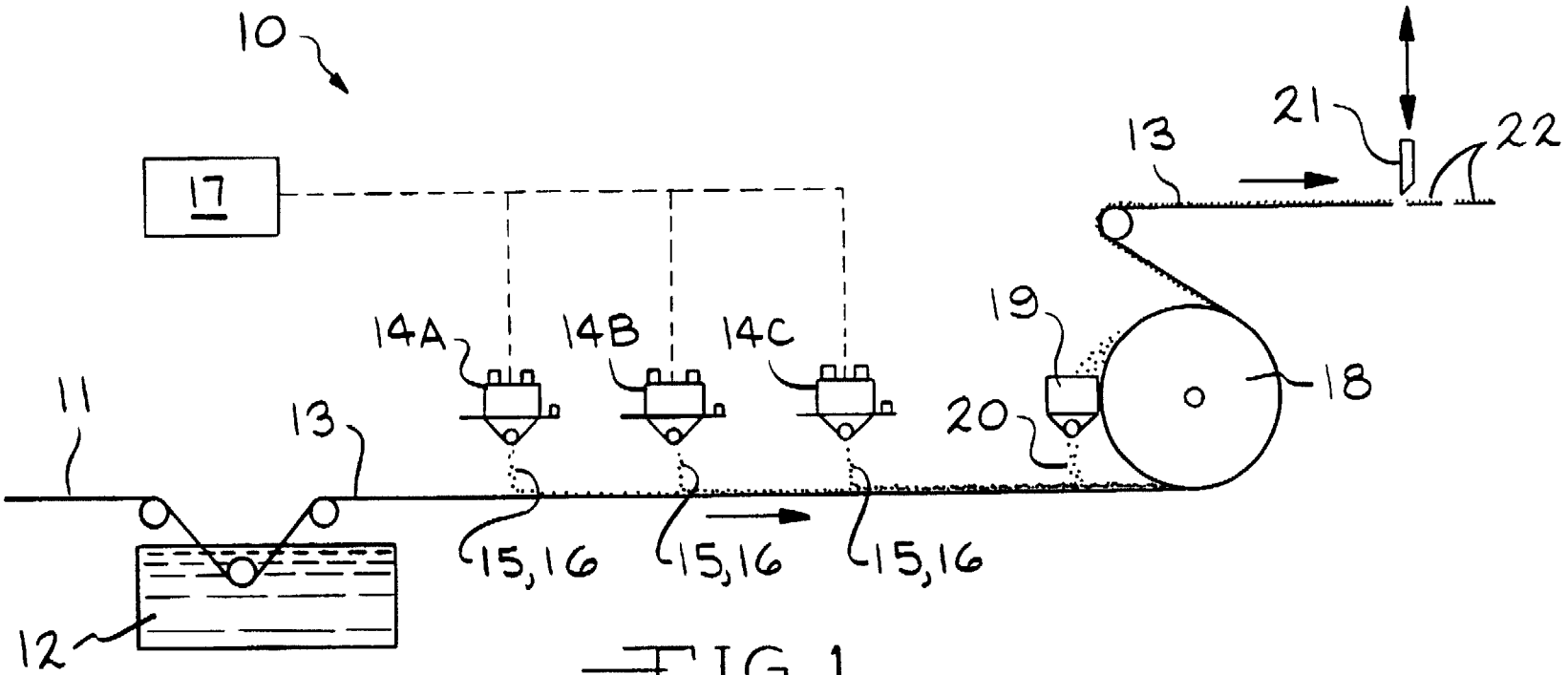
FIG. 1 is a schematic view in elevation of apparatus for forming a pattern of granules on a moving asphalt coated sheet according to the invention, by rotating a nozzle while discharging the granules.

Referring now to the drawings, FIG. 1 illustrates a portion of apparatus 10 for manufacturing roofing shingles according to a preferred embodiment of the invention. A continuous sheet 11 of a glass fiber mat or an organic felt mat is passed through a coater 12 containing hot, liquid asphalt material. This produces a tacky, asphalt coated sheet 13. The sheet then passes beneath one or more granule applicators 14A, 14B and 14C. Each granule applicator 14 discharges a flow of separate first and second granules 15, 16 onto the sheet. The granule applicators can be controlled by a controller 17, preferably in a programmable manner. Depending on the desired pattern, the granule applicators can be sequenced on and off, and they can be programmed differently or the same. Also, the position of the granule applicators relative to the prime portion of the sheet can be different or the same. The granule applicators will be described in more detail below.

Some of the discharged granules adhere to the tacky asphalt coating to form a pattern of granules on the sheet.

Some of the granules do not adhere to the sheet, such as granules which land on top of other granules instead of the tacky asphalt coating. The sheet 13 passes over a slate drum 18 which presses the granules into the tacky asphalt coating and inverts the sheet sufficiently for non-adhering granules to fall into a hopper 19.

Preferably, the hopper 19 recycles the blend of non-adhering granules by discharging them back onto the sheet as background granules 20. However, the background granules can also be supplied separately and discharged from another hopper onto the sheet. The background granules can be a blend of the granules used to form the pattern on the sheet, or they can be a different kind of granules. Optionally, any of the granules can also be used as headlap granules. A pattern could also be formed on an asphalt coated sheet without applying background granules. In some methods, background granules are applied to portions of the sheet before applying the granules used to form the pattern.

In the illustrated embodiment, the background granules 20 adhere to the tacky asphalt coating in the areas of the sheet not covered by the first and second granules 15, 16. From the drum 18, the sheet 13 passes through a conventional cooling section (not shown) and a cutter 21 which cuts the sheet into individual shingles 22.

Figure 3:
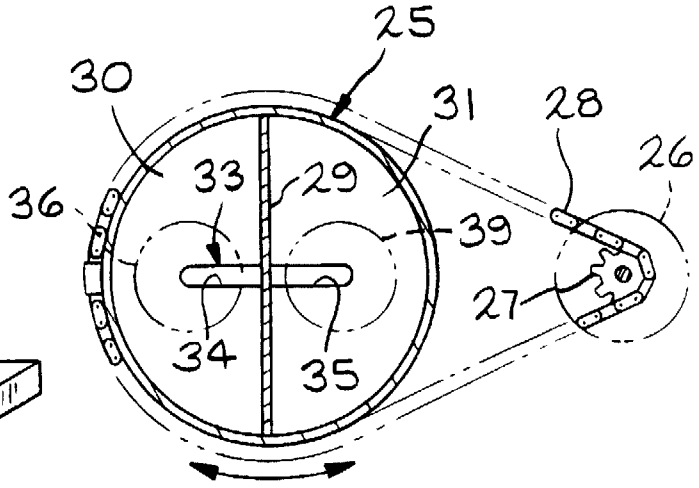
FIG. 3 is a cross-sectional view taken along line 3—3 of FIG. 2, showing the nozzle connected by a drive means to a motor for rotating the nozzle. The granules are not shown in this view.
Figure 2:
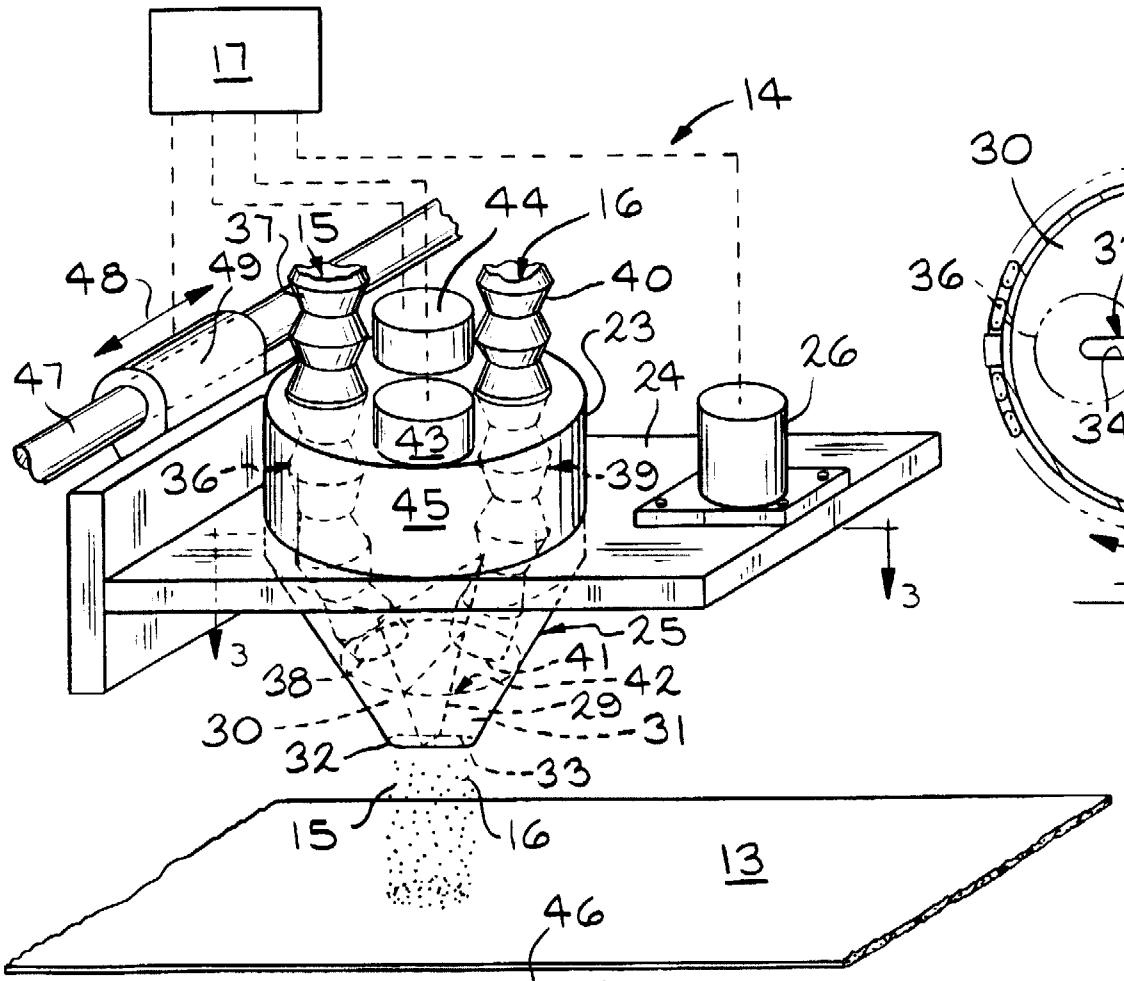
FIG. 2 is a perspective view of a granule applicator of FIG. 1 having a rotatable nozzle for discharging first and second granules onto the sheet.

As shown in FIGS. 2 and 3, a preferred granule applicator 14 includes a hollow, generally cylindrical applicator head 23. The applicator head is non-rotatably mounted in a generally horizontal mounting plate 24. A hollow, generally frustoconical nozzle 25 is mounted on the lower end of the applicator head. The nozzle is mounted for rotation relative to the applicator head by any suitable means, such as a support bearing (not shown). A stepper motor 26 or other discrete or continuous drive means is provided to rotate the nozzle. A rotatable gear 27 extends downward from the motor. A drive means such as a belt or chain 28 is connected around the gear and the perimeter of the nozzle. When the gear 27 is rotated by the motor 26, it causes rotation of the nozzle 25. A controller 17 is connected to the motor to control the rotation of the nozzle.

The nozzle 25 includes a divider 29 which divides the nozzle into a first discharge chamber 30 and a second discharge chamber 31. The nozzle tapers inwardly to a tip 32. The end of the tip defines an orifice 33. Preferably, the orifice is elongated as shown in FIGS. 2 and 3, but the orifice can be any shape suitable for forming a desired pattern, such as a circular, square or oval shape. The divider 29 separates the orifice 33 into a first slot 34 adapted for discharging granules from the first discharge chamber 30, and a second slot 35 adapted for discharging granules from the second discharge chamber 31.

A first granule feed chamber such as a first feed tube 36 is mounted inside the applicator head 23. The first feed tube is formed with a structure and from a material which allows the tube to rotate without collapsing on itself. For example, the first feed tube can be convoluted and formed of an elastomeric material. The first feed tube includes an upper portion 37 positioned above the granule applicator. First granules 15 are supplied from any source (not shown) into the upper portion of the first feed tube, and flow through the first feed tube into the granule applicator. The first feed tube also includes an output end 38. The first granules flow through the output end of the first feed tube into the first discharge chamber 30 of the nozzle 25.

A second granule feed chamber such as a second feed tube 39 is also mounted inside the applicator head. Like the first feed tube, the second feed tube is formed with a structure and from a material which allows the tube to rotate without collapsing. The second feed tube includes an upper portion 40 positioned above the granule applicator. Second granules 16 are supplied from any source (not shown) into the upper portion of the second feed tube, and flow through the second feed tube into the granule applicator. The second feed tube also includes an output end 41. The second granules flow through the output end of the second feed tube into the second discharge chamber 31 of the nozzle 25. The first granules and second granules form a pile or accumulation 42 of granules in the nozzle.

The granule applicator 14 also includes a pneumatic gating mechanism. The pneumatic gating mechanism includes a pressure port 43 for the inflow of pressurized air from any type of pressurized air source (not shown). A pressure solenoid valve (not shown) is positioned inside the pressure port for opening and closing the pressure port in order to start and stop the inflow of pressurized air. The pressurized air flows inside the hollow applicator head 23 and into the nozzle 25 of the granule applicator. The controller 17 is connected to the pressure solenoid valve to control the opening and closing of the pressure port.

The pneumatic gating mechanism also includes a vacuum port 44 for the outflow of air from the applicator head 23. The vacuum port is connected to any type of vacuum source (not shown) for applying a vacuum. A vacuum solenoid valve (not shown) is positioned inside the vacuum port for opening and closing the vacuum port in order to start and stop the vacuum. The controller 17 is connected to the vacuum solenoid valve to control the opening and closing of the vacuum port. The pressure solenoid valve and vacuum solenoid valve can be positioned at any location suitable for starting and stopping the air pressure and vacuum, respectively.

The interior of the applicator head 23 defines a buffer chamber 45 between the pressure port 43 and the vacuum port 44. The buffer chamber is positioned adjacent to the accumulation 42 of granules in the nozzle 25. In operation, when the pressure port is turned on and the vacuum port is turned off, pressurized air flows into the buffer chamber and increases the air pressure within the chamber. The force of the increased air pressure and gravity on the accumulation of granules ejects a flow of separate first and second granules from the nozzle. Specifically, first granules 15 are ejected through the first slot 34 in the nozzle 25, and second granules 16 are ejected through the second slot 35 in the nozzle 25. Preferably, the first and second granules are discharged simultaneously onto the sheet as described above. However, the flow can also include an alternating discharge of first and second granules, or a continuous discharge of one kind of granule with an intermittent discharge of the other kind of granule. The nozzle is rotated while ejecting the flow of granules.

By "eject", as used herein, is meant that the flow of granules is discharged toward the sheet by a force greater than the force of gravity. The flow of granules is forcefully propelled toward the sheet, preferably relatively rapidly. Ejecting the flow of granules from the granule applicator onto the sheet allows a desired shape of pattern to be obtained when the sheet is moving rapidly. If the flow of granules is dropped by gravity alone under such conditions, the resulting pattern may be undesirably elongated. The flow of granules can be ejected by any means, such as mechanically or electrostatically, but preferably the flow of granules is ejected pneumatically as described above.

When the pressure port 43 is turned off and the vacuum port 44 is turned on, the air pressure in the buffer chamber 45 is reduced. As a result, air flows from outside the granule applicator 14 through the first and second slots 34, 35 and upward through the accumulation 42 of granules in the nozzle 25. The upward flow of air provides an upwardly oriented drag force on the granules in contrast to the downward pull of gravity on the granules. The proper amount of vacuum is applied to the buffer chamber so that the drag force from the upward flow of air balances the pull of gravity on the granules. This holds the granules in place and stops the downward flow of granules from the nozzle.

If too much vacuum is applied so that the upward velocity of the air flow through the accumulation of granules exceeds a critical level, then the granules could become fluidized and begin to move as if they were caught in a fluid medium. The fluidization of the granules within the nozzle could create undesirable churning and mixing, or the granules could be pulled through the vacuum port. Consequently, the amount of vacuum is balanced to stop the flow of granules without causing fluidization.

By controlling the pressure port and vacuum port so that the flow of granules is alternately started and stopped, the granules can be discharged intermittently from the granule applicator onto the sheet. In addition to starting and stopping the flow of granules, the air pressure in the buffer chamber can also be varied to increase or decrease the amount and velocity of the flow. For example, the flow rate of the granules may be changed to compensate for a change in the speed of the asphalt coated sheet, so that the pattern looks the same at different speeds. Alternatively, the air pressure may be varied while discharging the flow of granules to form a varying pattern of granules on the sheet.

While the flow of granules is being discharged from the granule applicator 14, the sheet 13 moves in a machine direction 46. The mounting plate 24 for the granule applicator is mounted on a rail 47 for movement in a direction 48 which is transverse to the machine direction. A motorized drive mechanism 49 or other discrete or continuous drive means is provided to oscillate the mounting plate and granule applicator in the transverse direction 48. The drive mechanism can be controlled by the controller 17. In this manner, the granule applicator 14 including the nozzle 25 is adapted to oscillate in the transverse direction while discharging the flow of granules.

The rotation, oscillation, and intermittent discharge of the flow of granules can be controlled in a coordinated manner by the controller, to produce a wide variety of unique and attractive patterns on the sheet. Custom made and personalized patterns can be formed depending on the if particular needs and preferences of the customer. Any type of controller or controllers can be used, such as a computer or similar device. Preferably, the controller is programmable so that instructions can be entered for repeatably producing the desired patterns, and for coordinating the discharge of granules from the different granule applicators if more than one is used. The rotation, oscillation, and intermittent discharge of the flow of granules can be programmed together or independently.

Figure 4:
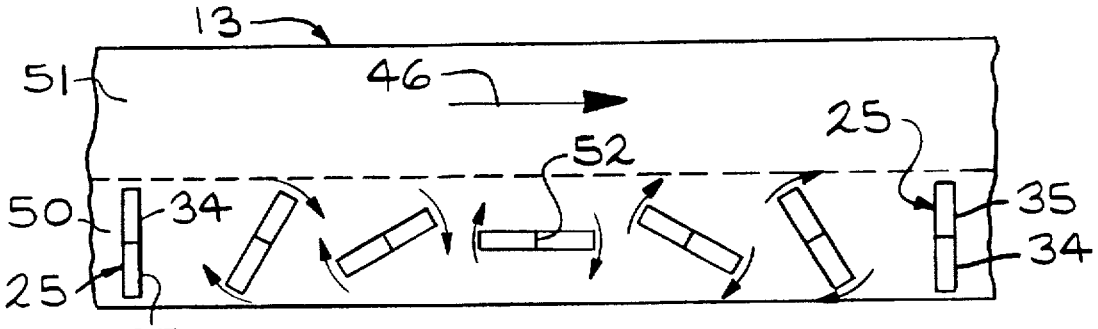
FIG. 4 is a plan view of an asphalt coated sheet illustrating schematically the nozzle being rotated while the sheet moves in a machine direction.

FIG. 4 illustrates the rotational movement of the nozzle 25 relative to the sheet 13, as the sheet moves in the machine direction 46. The sheet includes a prime portion 50 and a headlap portion 51. Preferably, the nozzle is positioned above the prime portion of the sheet while discharging the flow of granules. As shown at the left in FIG. 4, when the discharging is started, the first slot 34 for discharging first granules is positioned closer to the headlap portion 51 than the second slot 35 for discharging second granules. The nozzle can be rotated up to 180° or more while the sheet moves in the machine direction. As shown at the right in FIG. 4, when the nozzle has rotated 180°, the first and second slots 34, 35 have changed position such that the second slot 35 for discharging second granules is positioned closer to the headlap portion 51.

In the preferred embodiment of FIG. 4, the nozzle is rotated about an axis 52 which is generally perpendicular to the plane of the sheet 13. However, the axis of rotation can also be at an angle from perpendicular. The illustrated axis of rotation is located between the first slot 34 and the second slot 35, but the axis of rotation can also be located at other positions. For example, the axis of rotation can be located at the outer end of one of the slots. Although the illustrated first and second slots 34, 35 are generally the same in size and shape, the slots can also be different sizes and/or shapes. More than two slots can also be used in the invention. For example, three different colors of granules can be discharged from three slots. The slots can be located adjacent to one another to form a pattern having adjacent first and second granules, or the slots can be spaced apart to form a pattern of spaced first and second granules.

Figure 5:
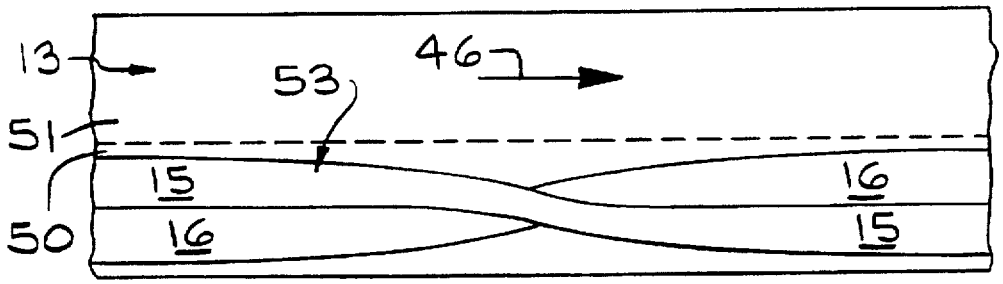
FIG. 5 is a plan view illustrating the pattern of first and second granules on the sheet discharged by the nozzle of FIG. 4.

FIG. 5 illustrates the pattern 53 of first and second granules 15, 16 formed on the sheet 13 when the nozzle rotates 180° as described above. It can be seen that the pattern of first and second granules changes along the machine direction 46. Specifically, when the discharging is started, the first granules 15 are located closer to the headlap portion 51 than the second granules 16. Midway through the discharging, the first and second granules cross over one another. When the discharging is completed, the granules have changed position such that the second granules 16 are located closer to the headlap portion 51 than the first granules 15. The resulting pattern is a unique and attractive design.

Figure 6:
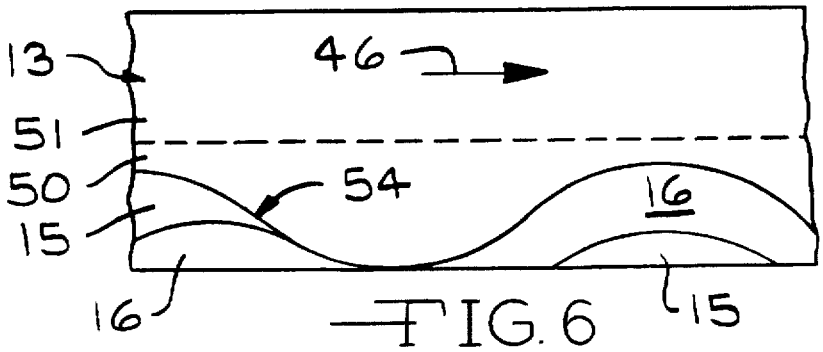
FIG. 6 is a plan view of a pattern on a sheet formed by a method in which the nozzle is both rotated and oscillated while discharging the granules.

As shown in FIG. 6, the granule applicator can be oscillated such that the discharging periodically extends off the sheet 13 to form a discontinuous pattern 54 of first and second granules 15, 16. Again, the nozzle is rotated so that the first and second granules change position along the machine direction 46.

Figure 7:
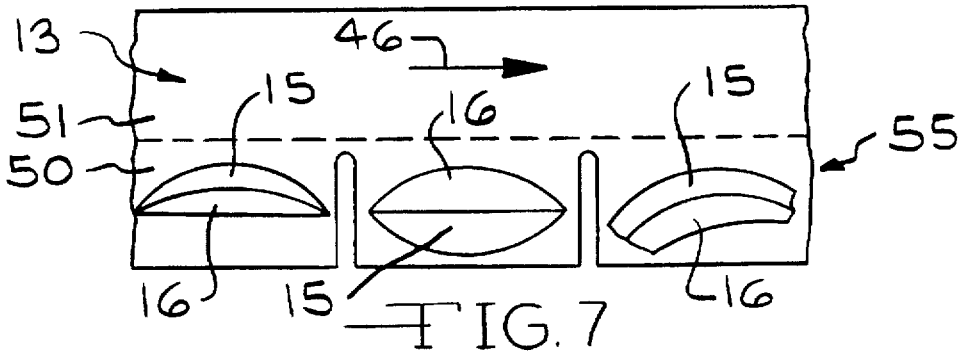
FIG. 7 is a plan view of a pattern on a sheet formed by a method in which the nozzle is rotated, oscillated, and turned on and off while discharging the granules.

As shown in FIG. 7, the granule applicator can be turned on and off such that the flow of granules is discharged intermittently onto the sheet lo 13. This forms an intermittent pattern 55 of first and second granules 15, 16 on the sheet. The first and second granules change position along the machine direction 46 because the nozzle is rotated. The nozzle is also oscillated to form a wavy look in portions of the pattern.

The first granules and second granules for use in the invention can be any kind of granules, such as roofing granules, that are different from one another in some manner. Some of the possible differences include:

different color, different size, different shape, different type of granule (e.g., different types of natural rock granules, or natural rock granules and ceramic coated granules), different resistance to microorganisms, different aging properties, or different shading properties. Preferably, the first and second granules are different in color.

Figure 8:
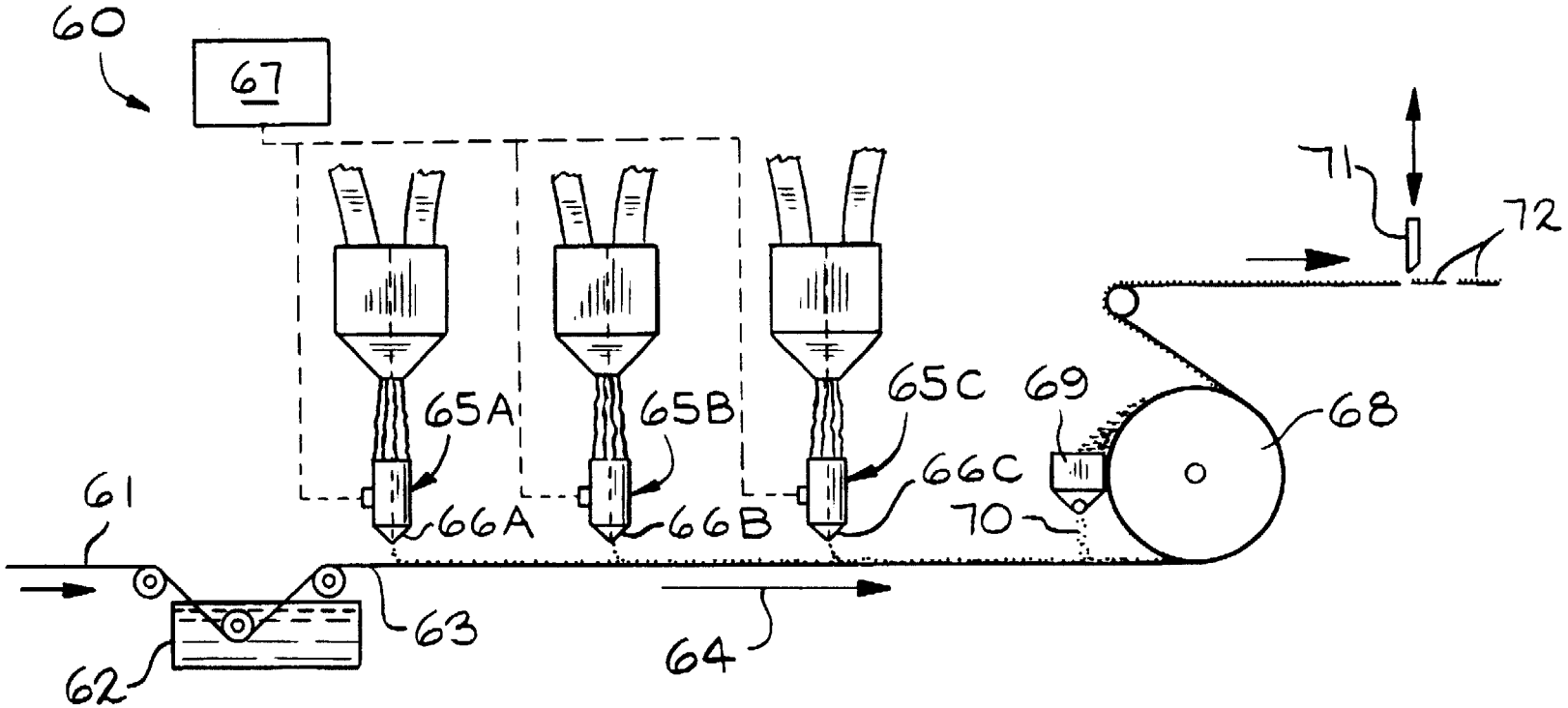
FIG. 8 is a schematic view in elevation of apparatus for forming a pattern of granules on a moving asphalt coated sheet according to the invention, by oscillating a granule applicator in a direction transverse to the machine direction while discharging the granules.

FIG. 8 illustrates a portion of apparatus 60 for manufacturing roofing shingles according to another preferred embodiment of the invention. A continuous sheet 61 of a glass fiber mat or an organic felt mat is passed through a coater 62 containing hot, liquid asphalt material. This produces a tacky, asphalt coated sheet 63. The sheet then passes in the machine direction 64 beneath one or more granule applicators 65A, 65B and 65C. The granule applicators have nozzles 66A, 66B and 66C. The granule applicators including the nozzles are adapted for oscillating in a direction transverse to the machine direction while discharging a flow of granules onto the sheet. A controller 67 is connected to the granule applicators for controlling their oscillation and the discharge of the granules. A granule applicator 65 will be described in more detail below.

The sheet 63 passes over a slate drum 68 which presses the granules into the tacky asphalt coating and inverts the sheet sufficiently for non-adhering granules to fall into a hopper 69. Preferably, the hopper discharges the non-adhering granules onto the sheet as background granules 70. From the drum 68, the sheet 63 passes through a conventional cooling section (not shown) and a cutter 71 which cuts the sheet into individual shingles 72.

Figure 9:
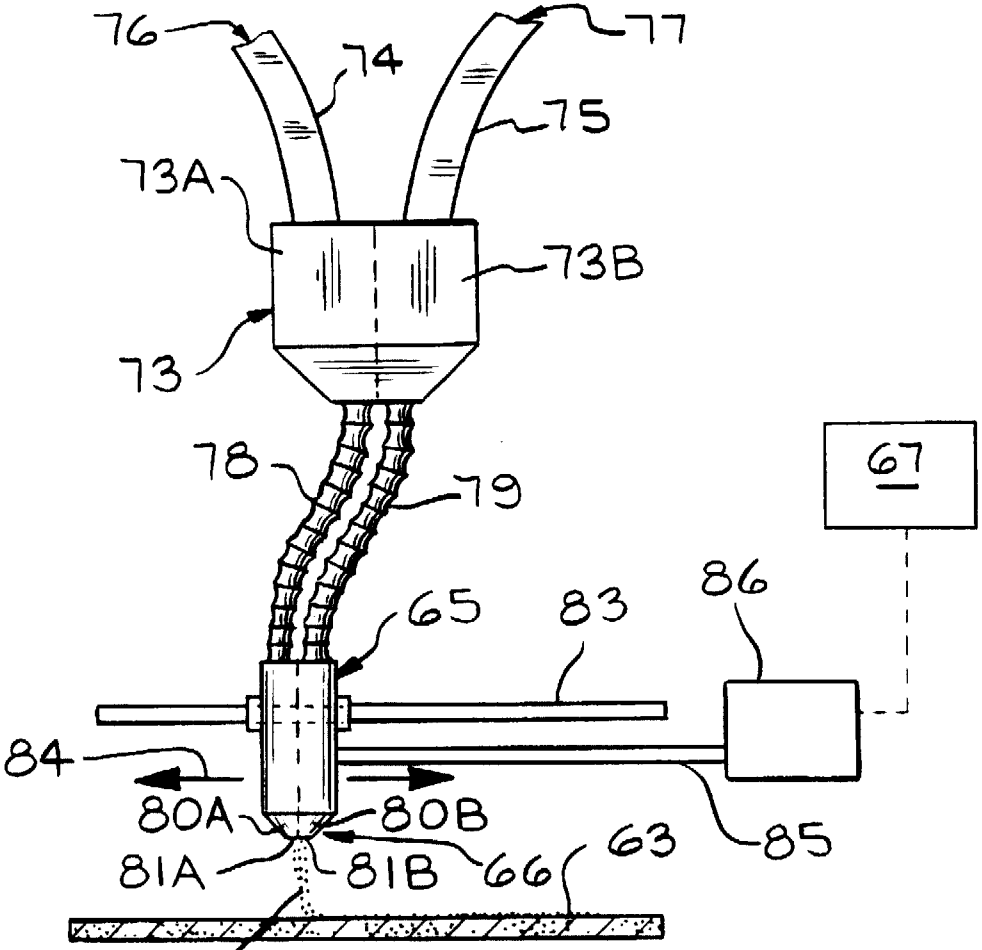
FIG. 9 is an elevational view of a granule applicator and a granule supply bin of FIG. 8, in which the granule applicator is mounted for oscillating in the transverse direction while discharging granules onto the sheet.

As shown in FIG. 9, a granule supply bin 73 is mounted over the sheet 63 by any conventional means. The granule supply bin includes a first supply chamber 73A and a second supply chamber 73B. First and second supply tubes 74, 75 feed a supply of first and second granules 76, 77 into the first and second supply chambers. First and second flexible feed hoses 78, 79 feed the first and second granules from the granule supply bin to a granule applicator 65. The granule applicator includes a nozzle 66. The first and second granules are separately fed into first and second granule discharge chambers 80A, 80B of the nozzle. A flow of separate first granules 76 and second granules 77 is discharged from the nozzle. Specifically, the first and second granules 76, 77 are discharged through first and second orifices 81A, 81B positioned in the tip of the nozzle. The granule applicator can be equipped with a pneumatic gating mechanism such as described above, or any other type of gating mechanism to start and stop the flow of granules. The first and second granules can be discharged adjacent to one another as shown, or they can be spaced apart. Optionally, a single kind of granules can be used to form the pattern instead of two or more different kinds of granules.

The granule applicator 65 is mounted for oscillating movement along a stationary guide rail 83. The guide rail is mounted above the sheet 63 by any suitable means (not shown), and is oriented in a direction 84 which is transverse to the machine direction of the sheet. The granule applicator 65 is connected to a drive rod 85 oriented in the transverse direction, generally parallel with the guide rail 83. A stepper motor 86 or other discrete or continuous drive means is provided to oscillate the drive rod in the transverse direction, thereby oscillating the granule applicator in the transverse direction along the guide rail. A controller 67 can be connected to the motor to control the oscillation of the granule applicator. Preferably, the controller is programmable. The controller can also be connected to the pneumatic gating mechanism to control the discharge of the flow of granules. The oscillation of the granule applicator and the discharge of the granules are preferably controlled in a coordinated manner.

FIGS. 10 through 16 illustrate different wave patterns formed on an asphalt coated sheet according to the present invention. The term "wave pattern", as used herein, means any pattern which can be formed by oscillating the flow of granules in the transverse direction while the sheet moves in the machine direction. Such wave patterns can include step patterns, patterns having abrupt turns, patterns with straight sections, and discontinuous patterns. In one embodiment of the invention, the pattern is formed generally as a sine wave. The amplitude of the wave is controlled by the distance of oscillation in the transverse direction. The frequency of the wave is controlled by the speed of oscillation. The wavelength of the wave is controlled by the speed of oscillation in the transverse direction relative to the speed of the sheet in the machine direction. Preferably, the relative speeds are controlled to form a pattern having a wavelength from about 20% to about 80% of the length of a shingle.

Figure 10:
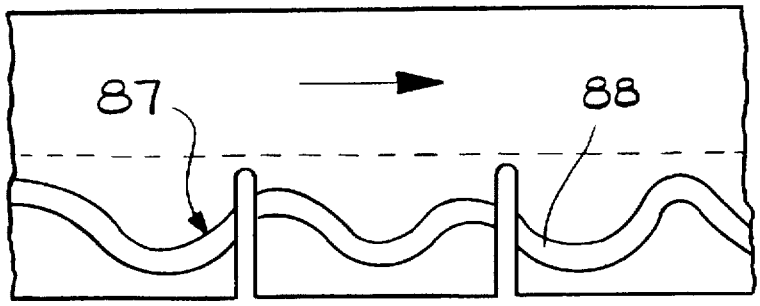
FIG. 10 is a plan view of a pattern on a sheet formed by a method in which the granule applicator is oscillated at a varying frequency while discharging the granules.
Figure 11:
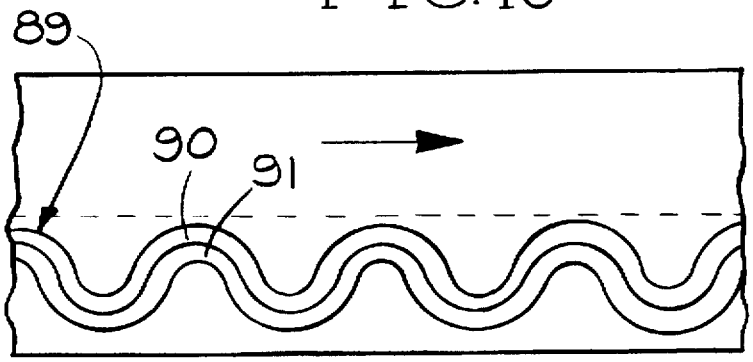
FIG. 11 is a plan view of a pattern on a sheet formed by a method in which the granule applicator is oscillated at a constant frequency while discharging first and second granules.
Figure 12:
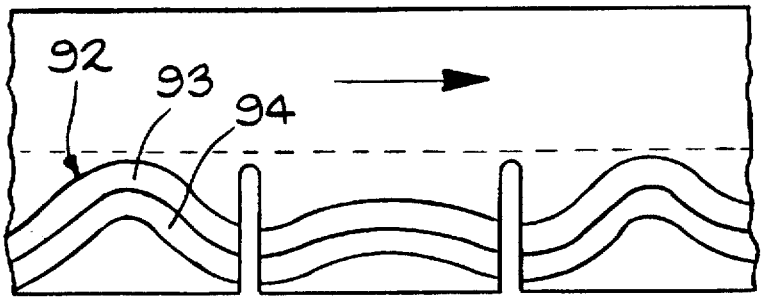
FIG. 12 is a plan view of a pattern on a sheet formed by a method in which the granule applicator is oscillated at a varying frequency while discharging first and second granules.
Figure 13:
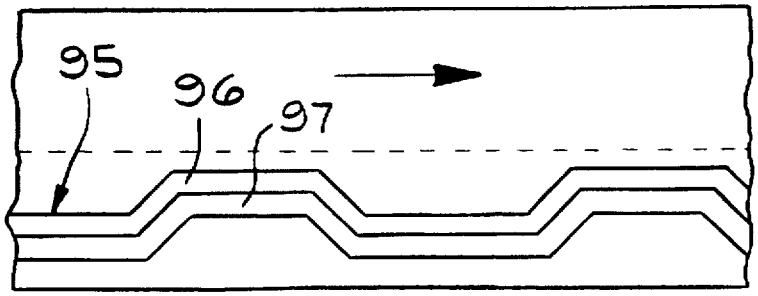
FIG. 13 is a plan view of a pattern on a sheet formed by a method in which the granule applicator is oscillated at a frequency varying in a step pattern while discharging first and second granules.

FIG. 10 illustrates a pattern 87 of a single kind of granules 88, formed by oscillating the granule applicator at a varying frequency while discharging the flow of granules. FIG. 11 illustrates a pattern 89 of first and second granules 90, 91, formed by oscillating the granule applicator at a constant frequency while discharging the flow of granules. FIG. 12 illustrates a pattern 92 of first and second granules 93, 94, formed by oscillating the granule applicator at a varying frequency while discharging the flow of granules. FIG. 13 illustrates a step pattern 95 of first and second granules 96, 97, formed by oscillating the granule applicator at a frequency varying in a step pattern while discharging the flow of granules.

Figure 14:
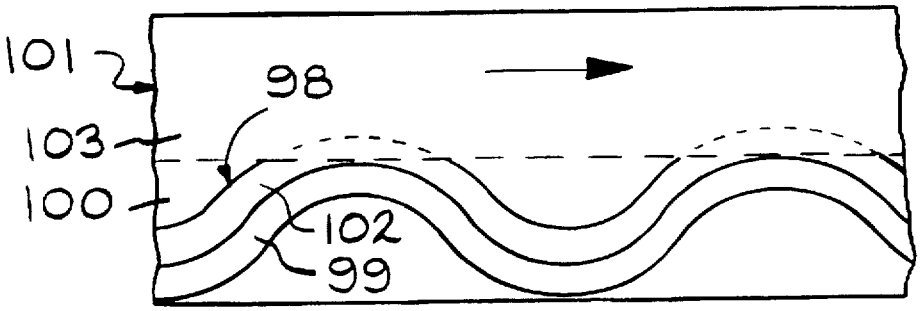
FIG. 14 is a plan view of a pattern on a sheet formed by a method in which the granule applicator is oscillated such that first granules are discharged along a path located in the prime portion of the sheet, while second granules are discharged along a path located in both the prime portion and the headlap portion. The dotted lines of the pattern indicate the portions of the pattern which will be covered by an adjacent sheet on the roof.

FIG. 14 illustrates a pattern 98 in which first granules 99 are discharged along a path located in the prime portion 100 of the sheet 101, while second granules 102 are discharged along a path located in both the prime portion 100 and the headlap portion 103 of the sheet. The resulting pattern produces a shadow effect. The pattern of first granules 99 appears to be a shadow of the pattern of second granules 102, particularly when the first granules are a darker color than the second granules.

Figure 15:
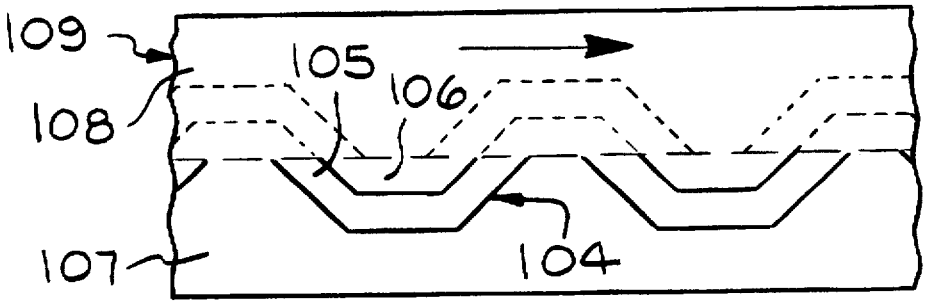
FIG. 15 is a plan view of a pattern on a sheet formed by a method in which the granule applicator is oscillated in a step pattern such that first and second granules are discharged along a path located in both the prime portion and the headlap portion of the sheet, to form a discontinuous pattern on the prime portion.
Figure 16:
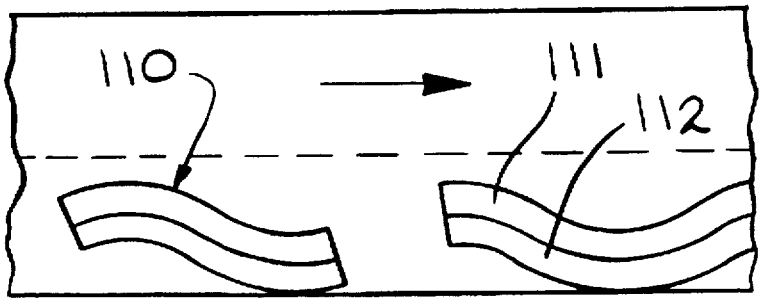
FIG. 16 is a plan view of a pattern on a sheet formed by a method in which first and second granules are discharged intermittently onto the sheet while oscillating the granule applicator.

FIG. 15 illustrates a pattern 104 in which first and second granules 105, 106 are discharged partially onto the prime portion 107 and partially onto the headlap portion 108 of the sheet 109. The resulting pattern is a discontinuous wave pattern on the prime portion 107. The illustrated pattern is a step pattern, but it could also be a regular pattern. FIG. 16 illustrates a pattern 110 in which the flow of granules is turned on and off to form an intermittent wave pattern of first and second granules 111, 112 on the sheet.

Figure 17:
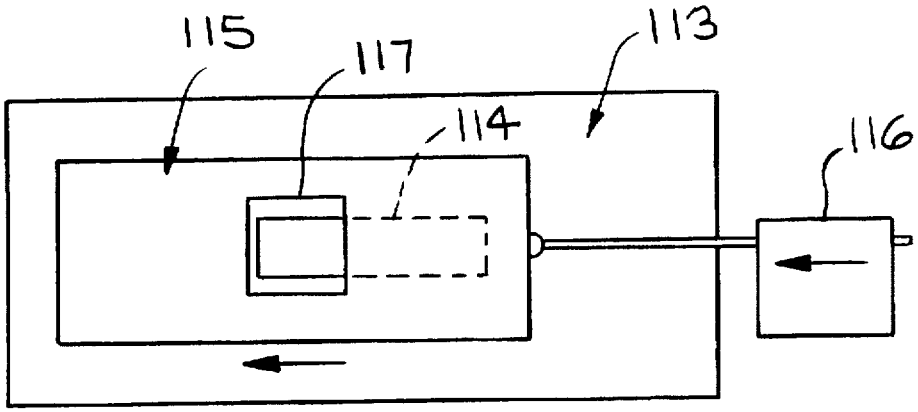
FIG. 17 is a bottom plan view of apparatus for forming a pattern of granules on an asphalt coated sheet according to the invention, by oscillating a valve positioned beneath a nozzle while discharging the granules. The valve is shown after movement in a first direction.
Figure 18:
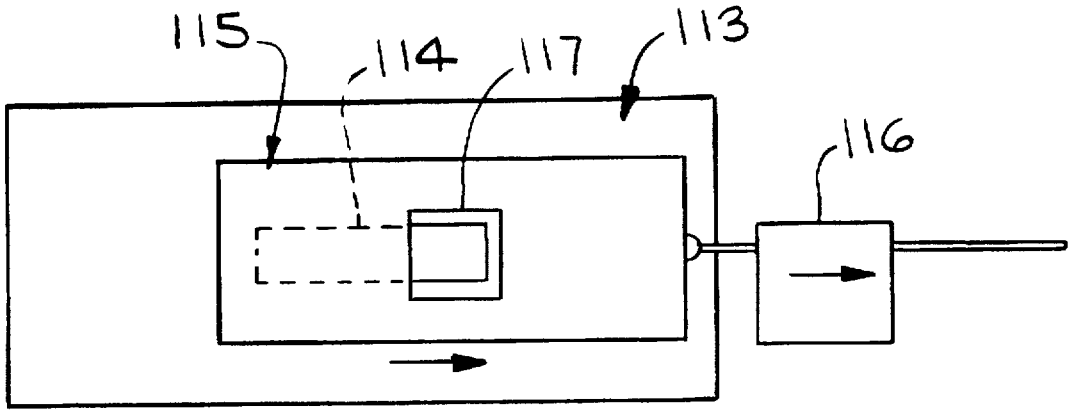
FIG. 18 is a view as in FIG. 17 in which the valve has been moved in a second direction opposite the first direction.
Figure 19:
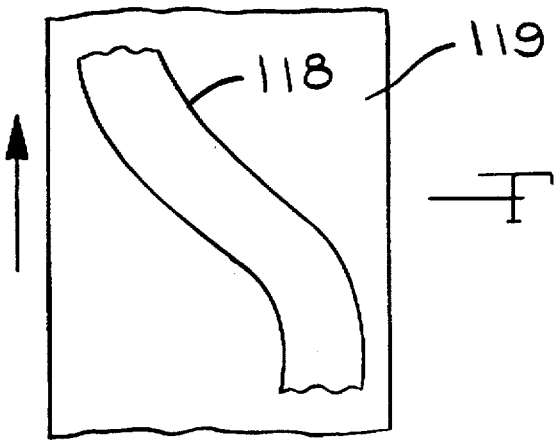
FIG. 19 is a schematic plan view of a wave pattern formed using the apparatus of FIG. 17.

FIGS. 17 through 19 illustrate an alternate embodiment of a method of oscillating the flow of granules to form a wave pattern on an asphalt coated sheet. In the method, a nozzle pan 113 of a granule applicator includes a discharge slot 114 for discharging granules. A shuttle valve 115 is mounted beneath the nozzle pan for oscillating movement over the discharge slot. A drive means such as a motor 116 is connected to the shuttle valve to control its movement. The shuttle valve has an orifice 117 through which granules can flow from the discharge slot for discharging onto the sheet. By oscillating the shuttle valve 115, a wave pattern 118 of granules is formed on the sheet 119. Many other structures can also be used for oscillating the flow of granules.

It should be understood that, although the methods of the invention have been described in relation to preferred granule applicators, any other types of granule applicators suitable for rotating and/or oscillating the flow is of granules can be used. Although the illustrated embodiments include three granule applicators, any desired number can be used (e.g., from one to four or more). The nozzle of the granule applicator can be generally linear or elongated in shape, instead of generally conical. Any suitable size and shape of orifices can be used for discharging the flow of granules. Any means can be used for starting and stopping the flow of granules.

The principle and mode of operation of this invention have been described in its preferred embodiment. However, it should be noted that this invention may be practiced otherwise than as specifically illustrated and described without departing from its scope.

We claim:

1. A method of forming a pattern of granules on an asphalt coated sheet moving in a machine direction comprising:

discharging a flow of separate first granules and second granules onto the sheet, and rotating the flow of granules to form a pattern comprising separate regions of first granules and second granules on the sheet, the rotation causing the regions of first granules and second granules to change position relative to one another along the machine direction.

2. The method according to claim 1 wherein the first granules are discharged from a first discharge chamber and the second granules are discharged from a second discharge chamber, and the first and second granules are fed, respectively, into the first and second discharge chambers by flexible feed tubes.

3. The method according to claim 1 wherein the flow of granules is discharged under pressure, and wherein the rate of discharge of the flow is changed by changing the pressure.

4. The method according to claim 1 wherein the first and second granules are separately discharged through first and second orifices of a nozzle, and wherein the nozzle is rotated about an axis generally perpendicular to the plane of the sheet.

5. The method according to claim 4 wherein the axis of rotation is located between the first and second orifices.

6. The method according to claim 4 wherein the axis of rotation is not located between the first and second orifices.

7. The method according to claim 1 wherein the first and second granules are discharged simultaneously onto the sheet.

8. The method according to claim 1 wherein the flow of granules is oscillated in a direction transverse to the machine direction.

9. The method according to claim 1 wherein the flow of granules is discharged intermittently onto the sheet.

10. The method according to claim 1 wherein the flow of granules is oscillated in a direction transverse to the machine direction, and the flow of granules is discharged intermittently onto the sheet, and wherein at least one of the rotation, oscillation, and intermittent discharge is controlled in a programmable manner.

11. The method according to claim 1 wherein the sheet is an asphalt roofing product including a prime portion and a headlap portion, the flow of granules is discharged onto the prime portion, then background granules are discharged onto the prime portion, and then the sheet is cut-into individual roofing shingles.

12. A method of forming a discontinuous pattern of granules on an asphalt coated sheet which is moving in a machine direction comprising:

ejecting a plurality of discrete flows of first granules and second granules at spaced intervals onto the asphalt coated sheet, each of the discrete flows of first granules being ejected separately from and simultaneously with the discrete flows of second granules, and oscillating the discrete flows in a direction transverse to the machine direction to form a discontinuous wave pattern of separate first granules and second granules adhered to the asphalt coated sheet.

13. The method according to claim 12 wherein a flow of separate first granules and second granules is ejected onto the sheet.

14. The method according to claim 13 wherein the first and second granules are ejected simultaneously onto the sheet.

15. The method according to claim 12 including the additional step of cutting the sheet into individual roofing shingles, wherein the speed of oscillation relative to the speed of the sheet is controlled to form a pattern having a wavelength from about 20% to about 80% of the length of a shingle.

16. The method according to claim 12 wherein the sheet is an asphalt roofing product including a prime portion and a headlap portion, and the oscillation is controlled so that the flows of granules are ejected along a path located partially in the prime portion and partially in the headlap portion, to form a discontinuous wave pattern on the prime portion.

17. The method according to claim 12 wherein the sheet is an asphalt roofing product including a prime portion and a headlap portion, and the oscillation is controlled so that the first granules are ejected along a path located in the prime portion, and the second granules are ejected along a path located in both the prime portion and the headlap portion.

18. The method according to claim 12 wherein the flows of granules are ejected under pressure, and wherein the rate of ejection of the flows is changed by changing the pressure.

19. The method according to claim, 12 wherein the sheet is an asphalt roofing product including a prime portion and a headlap portion, a flow of separate first granules and second granules is ejected onto the prime portion to form a wave pattern, then background granules are ejected onto the prime portion, and then the sheet is cut into individual roofing shingles.

20. A method of forming a pattern of granules on an asphalt coated sheet moving in a machine direction comprising:

discharging a flow of separate first granules and second granules onto the sheet, rotating the flow of granules to form a pattern comprising separate regions of first granules and second granules on the sheet the rotation causing the regions of first granules and second granules to change position relative to one another that along the machine direction, and oscillating the flow of granules in a direction transverse to the machine direction.

21. The method according to claim 20 wherein the sheet is an asphalt roofing product including a prime portion and a headlap portion, the flow of granules is discharged onto the prime portion, then background granules are discharged onto the prime portion, and then the sheet is cut into individual roofing shingles.

22. The method according to claim 20 wherein the rotation and oscillation are controlled in a programmable manner.

* * * * *